US009033490B2

(12) United States Patent
Kawamata et al.

(10) Patent No.: US 9,033,490 B2
(45) Date of Patent: May 19, 2015

(54) INK-JET RECORDING APPARATUS

(71) Applicants: Noriyuki Kawamata, Nagoya (JP); Yasuhira Ota, Yatomi (JP); Masao Mimoto, Nagoya (JP); Iwane Sano, Obu (JP); Jie Xiu, Nagoya (JP); Keisuke Wakakusa, Nagoya (JP); Shingo Ito, Kasugai (JP)

(72) Inventors: Noriyuki Kawamata, Nagoya (JP); Yasuhira Ota, Yatomi (JP); Masao Mimoto, Nagoya (JP); Iwane Sano, Obu (JP); Jie Xiu, Nagoya (JP); Keisuke Wakakusa, Nagoya (JP); Shingo Ito, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/179,794

(22) Filed: Feb. 13, 2014

(65) Prior Publication Data

US 2014/0232798 A1 Aug. 21, 2014

(30) Foreign Application Priority Data

Feb. 18, 2013 (JP) ..... 2013-029102

(51) Int. Cl.
*B41J 29/13* (2006.01)
*B41J 29/02* (2006.01)

(52) U.S. Cl.
CPC . *B41J 29/02* (2013.01); *B41J 29/13* (2013.01)

(58) Field of Classification Search
USPC ..... 347/108, 109, 8
See application file for complete search history.

(56) References Cited

U.S. PATENT DOCUMENTS

2006/0071389 A1 * 4/2006 Kozaki et al. ..... 271/9.11

FOREIGN PATENT DOCUMENTS

JP H05-000556 1/1993
JP 2003-326804 11/2003

* cited by examiner

*Primary Examiner* — Henok Legesse
(74) *Attorney, Agent, or Firm* — Frommer Lawrence & Haug LLP

(57) ABSTRACT

An ink-jet recording apparatus includes: a base member; a conveyor unit, supported by the base member, for conveying a sheet in a conveying direction parallel to a first direction; and a recording unit, supported by the base member, for ejecting ink when the recording unit is opposed to the sheet in a second direction perpendicular to the first direction. The base member is divided into a first base portion that supports the conveyor unit and the recording unit, a second base portion contiguous to the first base portion and located downstream of the first base portion in the conveying direction, and a third base portion contiguous to the second base portion and located downstream of the second base portion in the conveying direction. A stiffness of the second base portion is less than that of each of the first base portion and the third base portion.

11 Claims, 10 Drawing Sheets

10

INK-JET RECORDING APPARATUS

CROSS REFERENCE TO RELATED APPLICATION

The present application claims priority from Japanese Patent Application No. 2013-029102, which was filed on Feb. 18, 2013, the disclosure of which is herein incorporated by reference in its entirety.

BACKGROUND OF THE INVENTION

1. Field of the Invention

The present invention relates to an ink-jet recording apparatus including a resin base member formed as one member.

2. Description of the Related Art

An ink-jet recording apparatus has been known. This ink-jet recording apparatus controls a conveyor unit to convey a recording sheet through a conveyance path in a conveying direction and controls a recording unit to eject ink droplets to record an image on the recording sheet in a state in which the recording unit is opposed to the recording sheet in a direction perpendicular to the conveying direction.

In order to reduce a size, cost, the number of components, and the like, there has been known a structure of such an ink-jet recording apparatus which does not include a sheet metal component for positioning the conveyor unit and the recording unit but include a resin base member farmed as one member to directly support the conveyor unit and the recording unit.

SUMMARY OF THE INVENTION

Upon application of an external force, however, the resin base member is deformed more greatly than the sheet metal component. For example, if the ink-jet recording apparatus constructed as described above is placed over a step or raised, and thereby a bending moment is applied to the base member, a roller shaft of the conveyor unit may be bent or inclined, or a gap (i.e., a distance) between the recording unit and the recording sheet may be changed to an undesired one.

This invention has been developed to provide an ink-jet recording apparatus including a base member whose portion supporting a conveyor unit and a recording unit is less deformed by an external force acting on the apparatus.

The present invention provides an ink-jet recording apparatus comprising: a base member formed of one resin member, a conveyor unit supported by the base member and configured to convey a sheet in a conveying direction that is parallel to a first direction; a recording unit supported by the base member and configured to eject ink to record an image on the sheet in a state in which the recording unit is opposed to the sheet in a second direction perpendicular to the first direction wherein the base member is divided into (i) a first base portion that supports the conveyor unit and the recording unit, (ii) a second base portion contiguous to the first base portion and located downstream of the first base portion in the conveying direction, and (iii) a third base portion contiguous to the second base portion and located downstream of the second base portion in the conveying direction, and wherein a stiffness of the second base portion is less than that of each of the first base portion and the third base portion.

BRIEF DESCRIPTION OF THE DRAWINGS

The objects, features, advantages, and technical and industrial significance of the present invention will be better understood by reading the following detailed description of the embodiment of the invention, when considered in connection with the accompanying drawings, in which:

FIGS. 4A and 4B are perspective views illustrating of a base member 100, wherein FIG. 4A is a perspective view illustrating the base member 100 when viewed from diagonally above, and FIG. 4B is a perspective view illustrating the base member 100 when viewed from diagonally below;

FIGS. 5A-5C are cross-sectional views of FIG. 4A, wherein FIG. 5A is a cross-sectional view taken along line A-A in FIG. 4A, FIG. 5B is a cross-sectional view taken along line B-B in FIG. 4A, and FIG. 5C is a cross-sectional view taken along line C-C in FIG. 4A;

DETAILED DESCRIPTION OF THE EMBODIMENT

Hereinafter, there will be described one embodiment of the present invention by reference to the drawings. It is to be understood that the following embodiment is described only by way of example, and the invention may be otherwise embodied with various modifications without departing from the scope and spirit of the invention. A multi-function peripheral (MFP) 10 is used in a state illustrated in FIG. 1. In the present embodiment, three arrows illustrated in FIG. 1 indicate an up and down direction 7, a front and rear direction 8, and a right and left direction 9. In the following explanation, the up and down direction 7 is defined as an up and down direction of the MFP 10 illustrated in FIG. 1, i.e., the MFP 10 being in a normal state. Also, the front and rear direction 8 is defined by regarding a side of the MFP 10 on which an opening 13 is formed as a front side, and the right and left direction 9 is defined in a state in which the MFP 10 is seen form the front side. In the present embodiment, the front and rear direction 8 is one example of a first direction, the up and down direction 7 is one example of a second direction, and the right and left direction 9 is one example of a third direction.

<Overall Structure of MFP 10>

Figure 1:
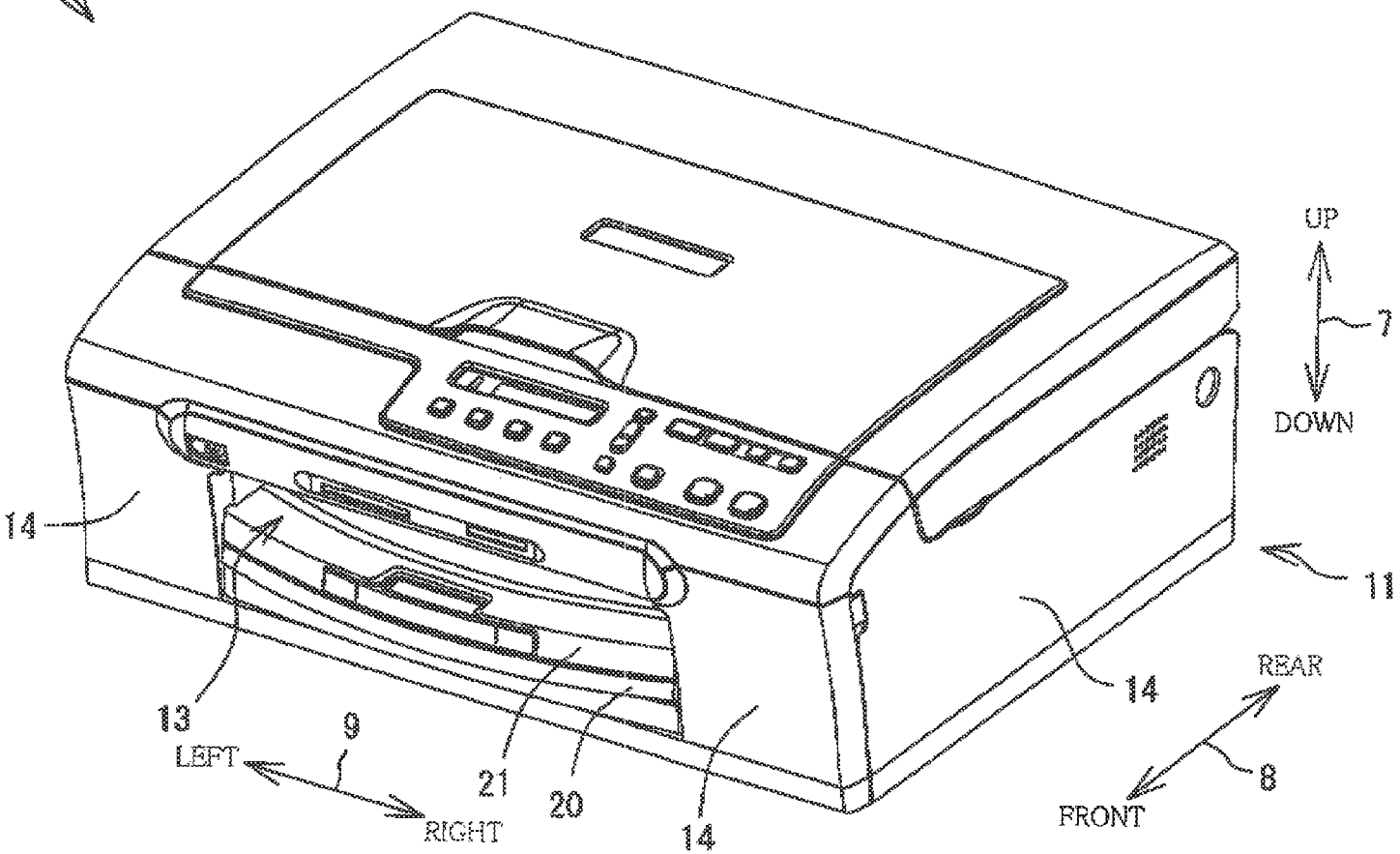
FIG. 1 is a perspective view illustrating a multi-function peripheral (MFP) 10 as one example of an embodiment of the present invention.

As illustrated in FIG. 1, the MFP 10 as one example of an ink-jet recording apparatus according to the present invention is of a slim type having a generally rectangular parallelepiped shape. A printing section 11 is provided in a lower portion of the MFP 10. The MFP 10 has various functions such as a facsimile function and a printing function. One example of the printing function of the MFP 10 is a function for ejecting ink to record an image on one side of a recording sheet 12 (see FIG. 2). It is noted that the MFP 10 may be configured to record images on both sides of the recording sheet 12.

As illustrated in FIG. 1, the opening 13 is formed in a front face of the printing section 11. A supply tray 20 capable of accommodating recording sheet 12 of various sizes can be inserted into and removed from the printing section 11 through the opening 13 in the front and rear direction 8. An output tray 21 is stacked on the supply tray 20. The output tray 21 is moved together with the supply tray 20. The output tray 21 supports a recording sheet 12 recorded by a recording unit 24 which will be described below and discharged by an output roller pair 61 which will be described below.

<Supply Tray 20>

Figure 3:
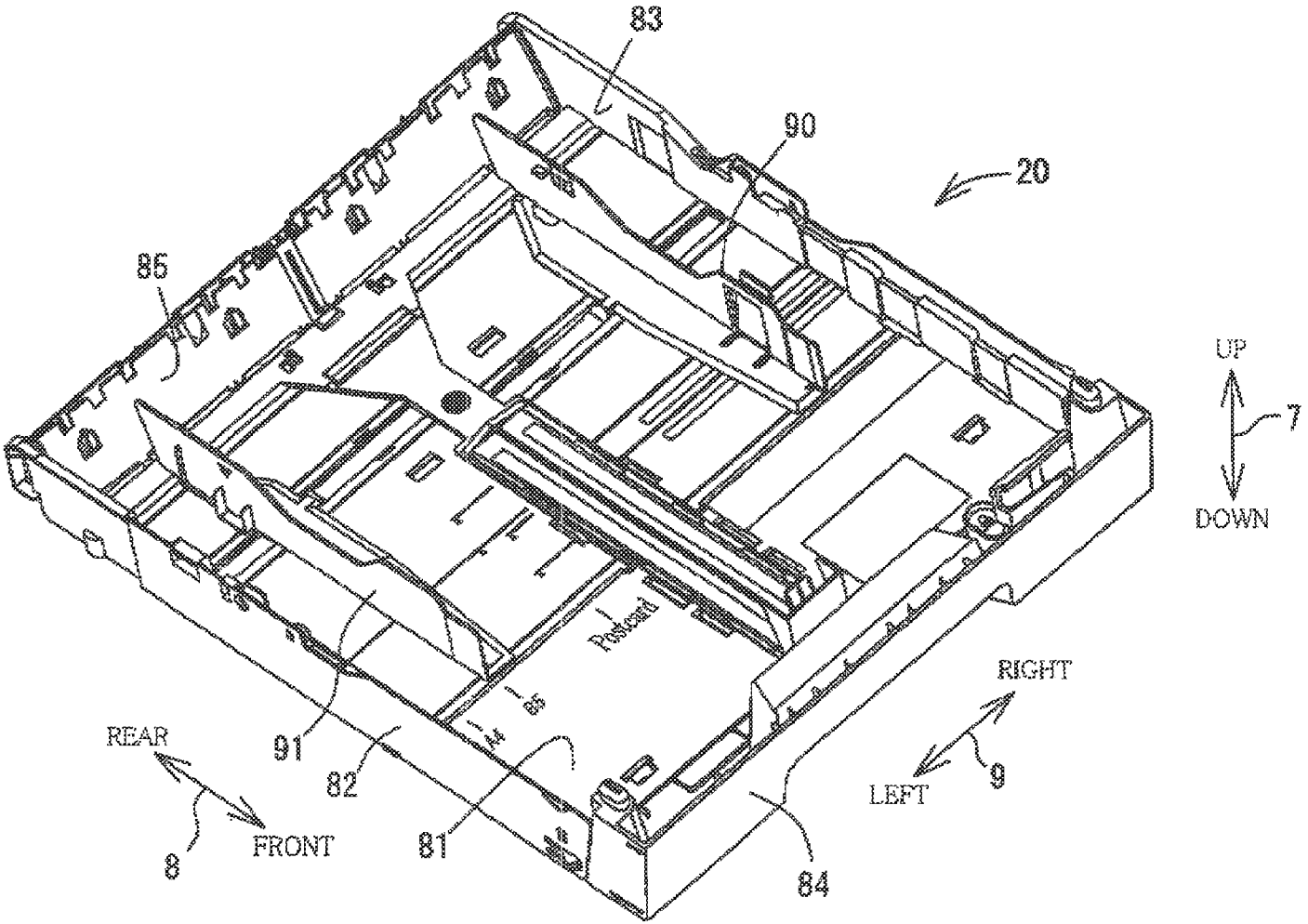
FIG. 3 is a perspective view illustrating a supply tray 20.

As illustrated in FIG. 3, the supply tray 20 has a box shape opening upward and includes a bottom plate 81, a left side plate 82, a right side plate 83, a front plate 84, and an inclined plate 85. The left side plate 82 and the right side plate 83 project upward respectively from opposite edge portions of the bottom plate 81 in the right and left direction 9. The front plate 84 projects upward from a front edge portion of the bottom plate 81 in the front and rear direction 8. The output tray 21 is supported by the left side plate 82, the right side plate 83, and the front plate 84 (see FIG. 1). The inclined plate 85 extends in a rear upward direction from a rear end of the bottom plate 81 in the front and rear direction 8 to guide a recording sheet 12 to a conveyance path 35 after the recording sheet 12 is supplied from a supply unit 16.

The bottom plate 81 can support recording sheets 12 of a plurality of standard sizes such as the A4 size, the B5 size, the legal size, and the postcard size. The bottom plate 81 has marks each indicating a position of one of edge portions (a left edge portion in the example in FIG. 3) of the recording sheet 12 of a corresponding one of the various standard sizes in the right and left direction 9. FIG. 3 illustrates "A4", "B5", and "Postcard" as examples of the mark, but other marks may be used of course. As illustrated in FIG. 3, provided on the bottom plate 81 are guide members 90, 91 for positioning a recording sheet or sheets 12 placed on the bottom plate 81 by contacting opposite edges of the recording sheet(s) 12 in the right and left direction. The guide members 90, 91 use center alignment to prevent skew of the recording sheet 12 and to position the various standard sizes of the recording sheets 12 placed on the bottom plate 81. The center alignment is an operation for aligning a center of each recording sheet 12 in the right and left direction 9 to a center of the bottom plate 81 in the right and left direction 9.

A user places the recording sheet(s) 12 on the bottom plate 81 such that the cater of each recording sheet 12 is aligned to a center line of the bottom plate 81 in the right and left direction 9. The user then slides the guide member 90 in the left direction of the right and left direction 9 to a position indicated by the mark that corresponds to the size of the recording sheet(s) 12, so that the guide member 90 is brought into contact with a right edge of the recording sheet(s) 12. The guide member 91 is slid in the right direction by a pinion gear, not shown, in conjunction with the guide member 90 and brought into contact with a left edge of the recording sheet(s) 12. The recording sheet or sheets 12 of the various standard sizes placed on the bottom plate 81 are thus positioned by the guide members 90, 91 using the center alignment.

Figure 2:
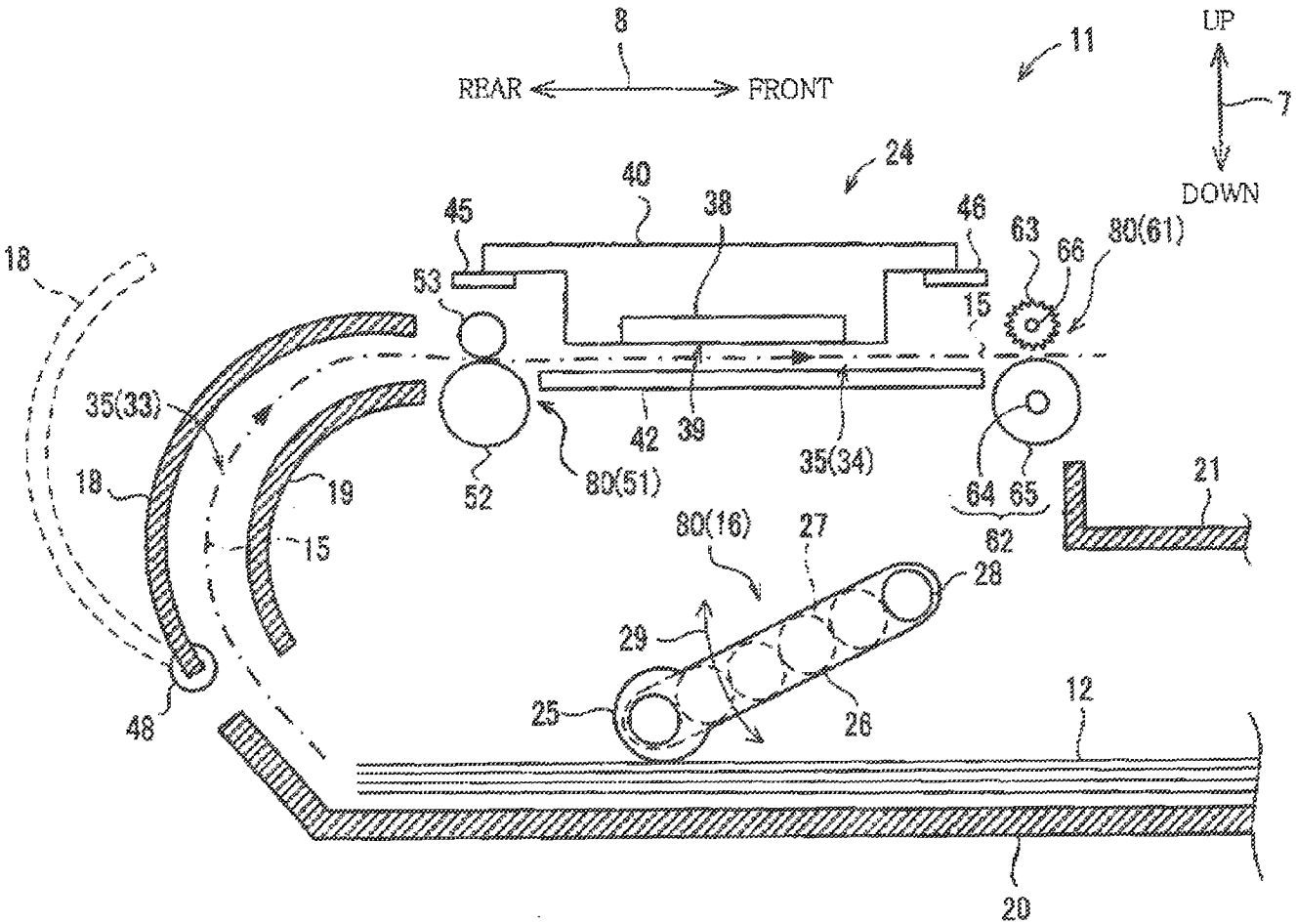
FIG. 2 is an elevational view in vertical cross section schematically illustrating an internal structure of a printing section 11.

The printing section 11 includes a base member 100 (see FIG. 4) and an exterior cover 14 for covering the base member 100 from above. As illustrated in FIG. 2, components provided in the printing section 11 include the supply unit 16, a conveyor roller pair 51, the recording unit 24, the output roller pair 61, and a platen 42. In the printing section 11, the base member 100 supports the supply unit 16, the conveyor roller pair 51, the recording unit 24, the output roller pair 61, the platen 42, and other components, which are covered with the exterior cover 14.

The supply unit 16 picks up one of the recording sheets 12 from the supply tray 20 to supply the recording sheet 12 to the conveyance path 35. The conveyor roller pair 51 conveys the recording sheet 12 supplied by the supply unit 16 into the conveyance path 35, to a downstream side in a conveying direction 15. The recording unit 24 ejects ink droplets onto the recording sheet 12 conveyed by the conveyor roller pair 51, to record an image on the recording sheet 12. The output roller pair 61 discharges onto the output tray 21 the recording sheet 12 recorded by the recording unit 24. The platen 42 supports a lower side of the recording sheet 12 conveyed by the conveyor roller pair 51.

<Conveyance Path 35>

As illustrated in FIG. 2, the conveyance path 35 extends from a rear edge portion of the supply tray 20. The conveyance path 35 includes a curved conveyance path 33 and a straight conveyance path 34. The curved conveyance path 33 curves, with a rear side of the printing section 11 being as an outside of the path 33. The straight conveyance path 34 extends in the front and rear direction 8. The recording sheet 12 supported on the supply tray 20 is conveyed so as to make an upward U-turn through the curved conveyance path 33 from a lower portion thereof and then conveyed frontward in the front and rear direction 8 through the straight conveyance path 34 to the recording unit 24. After the image recording for the recording unit 24, the recording sheet 12 is conveyed frontward in the front and rear direction 8 through the straight conveyance path 34 and discharged onto the output tray 21. That is, the recording sheet 12 is conveyed in the conveying direction 15 indicated by one-dot chain line arrow in FIG. 2.

The curved conveyance path 33 is defined by an outer guide member 18 and an inner guide member 19 which are opposed to each other with a predetermined distance therebetween. The outer guide member 18 serves as an outer wall of the curved conveyance path 33, and the inner guide member 19 serves as an inner wall of the curved conveyance path 33. The straight conveyance path 34 is defined by the recording unit 24 and the platen 42 which are opposed to each other with a predetermined distance therebetween at a position where the recording unit 24 is disposed. That is, each of the guide members 18, 19 forms at least a portion of the conveyance path 35.

The outer guide member 18 is pivotably supported by the base member 100 which will be described below. Shafts 48 each extending in the right and left direction 9 are formed respectively on opposite ends of a lower end portion of the outer guide member 18 in the right and left direction 9. In the present embodiment, each of the shafts 48 is a projection extending outward from a corresponding one of the opposite ends of the outer guide member 18 in the right and left direction 9. The shaft 48 are fitted in holes, not shown, formed in the base member 100. As a result, the outer guide member 18 is pivotable between a covering position (indicated by solid lines in FIG. 2) where the outer guide member 18 covers the curved conveyance path 33 and an exposing position (indicated by broken lines in FIG. 2) where the outer guide member 18 exposes the curved conveyance path 33.

At the covering position, the outer guide member 18 defines the curved conveyance path 33 of the conveyance path 35 with the inner guide member 19. At the exposing position of the outer guide member 18, on the other hand, an outside face of the inner guide member 19 is exposed to an outside of the printing section 11. That is, the outer guide member 18 at the exposing position exposes the curved conveyance path 33 of the conveyance path 35 to the outside. As a result, the user of the MFP 10 can clear a recording sheet 12 stuck in the curved conveyance path 33, in other words, the user can perform a jam clearing operation.

<Conveyor Unit 80>

A conveyor unit 80 includes: the supply unit 16 disposed upstream of the curved conveyance path 33 in the conveying direction 15; the conveyor roller pair 51 disposed in the straight conveyance path 34 at a position located upstream of the recording unit 24 in the conveying direction 15; and the output roller pair 61 disposed in the straight conveyance path 34 at a position located downstream of the recording unit 24 in the conveying direction 15.

<Supply Unit 16>

As illustrated in FIG. 2, the supply unit 16 is provided above the supply tray 20 and under the recording unit 24 in the printing section 11. The supply unit 16 includes a supply roller 25, a supply arm 26, and a drive-power transmitting mechanism 27. The supply roller 25 is supported by a shaft at a distal end portion of the supply arm 26. The supply arm 26 pivots in a direction indicated by arrow 29 about a support shaft 28 provided on a basal end portion of the supply arm 26. As a result, the supply roller 25 can be moved toward and away from the supply tray 20 or the recording sheet 12 supported on the supply tray 20. The supply roller 25 is rotated by a driving force produced by a conveyor motor, not shown, which is transmitted by the drive-power transmitting mechanism 27 constituted by a plurality of gears. It is noted that the supply roller 25 may be rotated by a driving force applied from a motor provided independently of the conveyor motor.

<Conveyor Roller Pair 51>

As illustrated in FIG. 2, the conveyor roller pair 51 is constituted by a conveyor roller 52 and pinch rollers 53. In the present embodiment, the conveyor roller 52 is formed by coating an outer circumferential surface of a roller shaft with ceramic, for example. Also, a metal cylindrical shaft (e.g., a hollow shaft) is employed as the roller shaft in the present embodiment. However, a concrete structure of the conveyor roller 52 is not limited to this structure. For example, the conveyor roller 52 may be formed by fitting a roller on the roller shaft, and a solid shaft may be employed as the roller shaft.

In the present embodiment, the conveyor roller 52 is disposed in a lower portion of the straight conveyance path 34 and contacts a lower side of the recording sheet 12 conveyed from the curved conveyance path 33 to the straight conveyance path 34. The conveyor roller 52 is rotated by a driving force applied from a conveyor motor that is capable of rotating forwardly and reversely. On the other hand, the pinch rollers 53 are disposed in an upper portion of the straight conveyance path 34 so as to be opposed to the conveyor roller 52 and contact an upper side of the recording sheet 12. The pinch rollers 53 are rotated by the rotation of the conveyor roller 52. The conveyor roller 52 and the pinch rollers 53 cooperate to nip the recording sheet 12 in the up and down direction 7 to convey the recording sheet 12 in the conveying direction 15.

The conveyor roller 52 is rotated forwardly by a driving force applied from the conveyor motor rotating forwardly. Here, the forward rotation of the conveyor roller 52 is rotation in a direction in which the recording sheet 12 is conveyed in the conveying direction 15. That is, the forward rotation of the conveyor roller 52 when the printing section 11 is viewed in a direction in FIG. 2 is rotation in the clockwise direction, and the forward rotation of the pinch rollers 53 is rotation in the counterclockwise direction. On the other hand, the conveyor roller 52 is rotated reversely by a driving force applied from the conveyor motor rotating reversely. The reverse rotation of the conveyor roller 52 is rotation in a direction in which the recording sheet 12 is conveyed in a direction that is reverse to the conveying direction 15. That is, the reverse rotation of the conveyor roller 52 when the printing section 11 is viewed in the direction in FIG. 2 is rotation in the counterclockwise direction, and the reverse rotation of the pinch rollers 53 is rotation in the clockwise direction.

<Output Roller Pair 61>

As illustrated in FIG. 2, the output roller pair 61 is constituted by an output roller 62 and spurs 63. In the present embodiment, the output roller 62 is disposed in a lower portion of the straight conveyance path 34 and contacts the lower side of the recording sheet 12 conveyed through the straight conveyance path 34. The output roller 62 is constituted by a shaft 64 rotated by a driving force applied from the conveyor motor and rollers 65 fitted on the shaft 64 so as to be rotated together with the shaft 64. On the other hand, the spurs 63 are disposed in an upper portion of the straight conveyance path 34 so as to be opposed to the output roller 62 and contact the upper side of the recording sheet 12. The spurs 63 are respectively fitted on shafts 66 and rotated by the rotation of the output roller 62. The output roller 62 and the spurs 63 cooperate to nip the recording sheet 12 in the up and down direction 7 to convey the recording sheet 12 in the conveying direction 15.

The output roller 62 is rotated forwardly by a driving force applied from the conveyor motor rotating forwardly. Here, the forward rotation of the output roller 62 is rotation in the direction in which the recording sheet 12 is conveyed in the conveying direction 15. That is, the forward rotation of the output roller 62 when the printing section 11 is viewed in the direction in FIG. 2 is rotation in the clockwise direction, and the forward rotation of the spurs 63 is rotation in the counterclockwise direction. On the other hand, the output roller 62 is rotated reversely by a driving force applied from the conveyor motor rotating reversely. The reverse rotation of the output roller 62 is rotation in the direction in which the recording sheet 12 is conveyed in the direction that is reverse to the conveying direction 15. That is, the reverse rotation of the output roller 62 when the printing section 11 is viewed in the direction in FIG. 2 is rotation in the counterclockwise direction, and the reverse rotation of the spurs 63 is rotation in the clockwise direction.

<Platen 42>

As illustrated in FIG. 2, the platen 42 is provided in a lower portion of the straight conveyance path 34 and between the conveyor roller pair 51 and the output roller pair 61, that is, the platen 42 is provided downstream of the conveyor roller pair 51 in the conveying direction 15 and upstream of the output roller pair 61 in the conveying direction 15. The platen 42 is disposed so as to be opposed to the recording unit 24 in the up and down direction 7 to support the lower side of the recording sheet 12 conveyed through the straight conveyance path 34.

<Recording Unit 24>

As illustrated in FIG. 2, the recording unit 24 is disposed in an upper portion of the straight conveyance path 34 so as to be opposed to the platen 42 in the up and down direction 7. The recording unit 24 includes a carriage 40 and a recording head 38. The carriage 40 is supported by two guide rails 45, 46. The two guide rails 45, 46 each extending in the right and left direction 9 are arranged so as to be spaced apart from each other in the front and rear direction 8. The carriage 40 is disposed over the two guide rails 45, 46 and reciprocated along the two guide rails 45, 46 in the right and left direction 9 as a main scanning direction. The recording head 38 is mounted on the carriage 40. A lower face of the recording head 38 has nozzles 39 through which the recording head 38 ejects ink supplied from an ink cartridge, not shown. That is, during the reciprocation of the carriage 40 in the right and left direction 9, the recording head 38 ejects ink droplets from the nozzles 39 toward the platen 42 to record an image on the recording sheet 12 supported on the platen 42.

<Base Member 100>

Figure 4B:
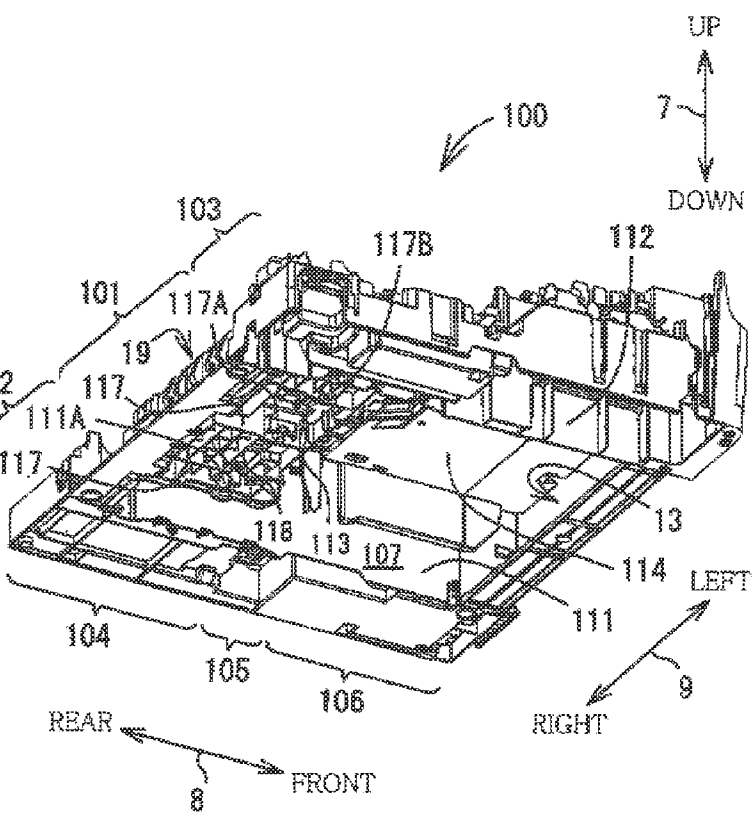
Figure 4A:
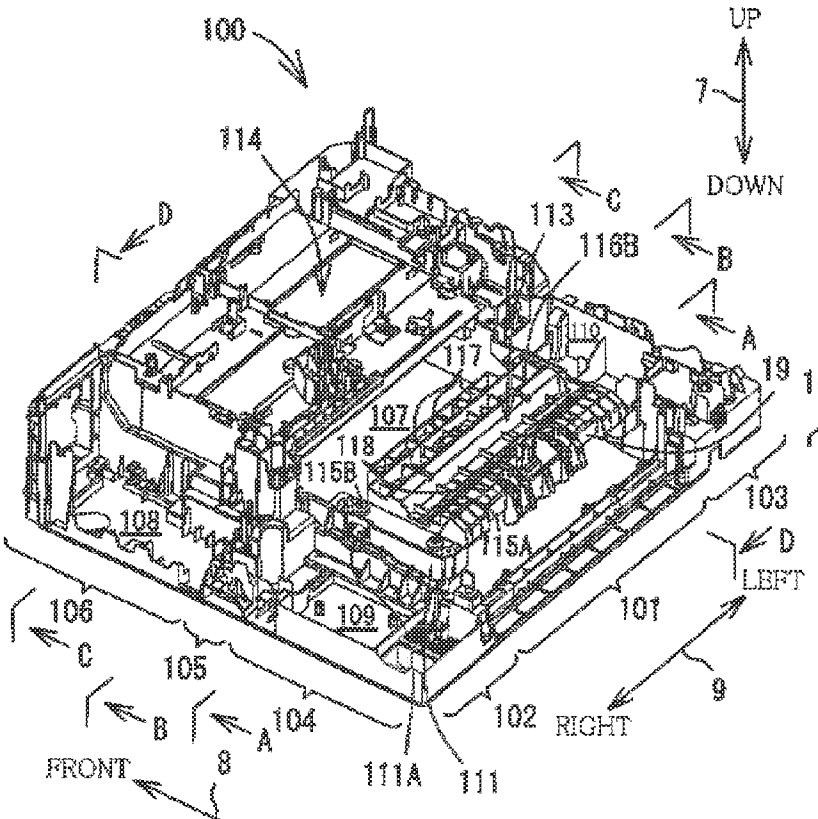

As illustrated in FIGS. 4A and 4B, the base member 100 is constituted by: a center base 101 located at a central portion thereof in the right and left direction 9; and side bases 102, 103 contiguous to the center base 101 in the right and left direction 9. The side base 102 is located on the right side of the center base 101, and the side base 103 on the left side of the center base 101. That is, the side bases 102, 103 are spaced apart from each other in the right and left direction 9. Also, the center base 101 is located between the side bases 102, 103 in the right and left direction 9. In the present embodiment, the base member 100 is formed of resin as one member.

The center base 101 has a tray accommodation space 107 for accommodating the supply tray 20 and the output tray 21. The center base 101 supports the supply unit 16, the recording unit 24, the conveyor roller pair 51, the output roller pair 61, the platen 42, a control board 47, and other components. The recording sheet 12 is conveyed by the conveyor unit 80 from the supply tray 20 to the output tray 21 through the conveyance path 35 formed in the center base 101.

Figure 9:
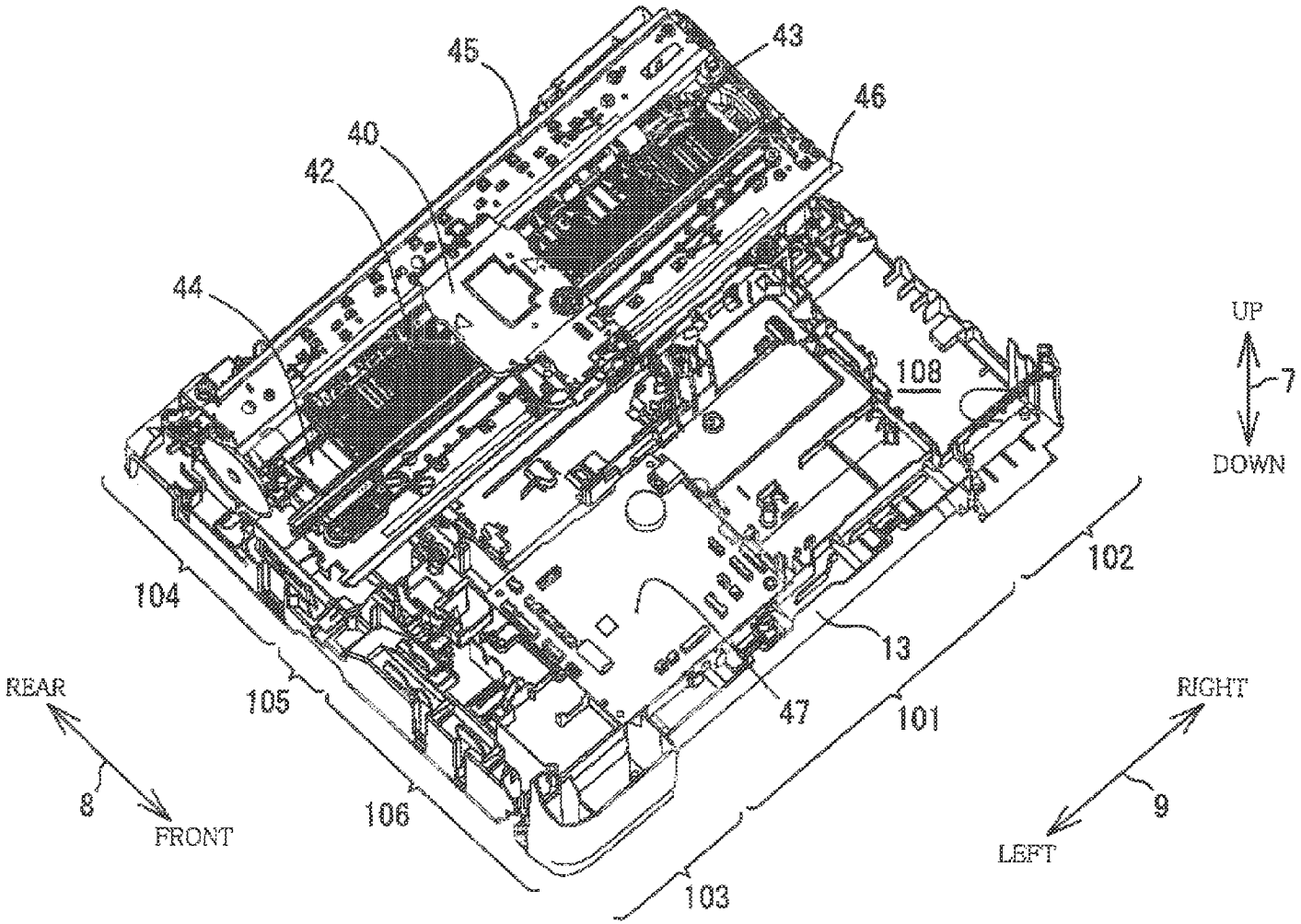
FIG. 9 is a perspective view illustrating the base member 100 on which a carriage 40 is mounted.

The side base 102 has a cartridge accommodation space 108 for accommodating an ink cartridge, not shown, and a purging mechanism accommodation space 109 for accommodating a purging mechanism 43 (see FIG. 9). The side base 103 has a flushing tank accommodation space 110 for accommodating a flushing tank 44 or a waste ink tank. It is noted that the purging mechanism 43 uses a pump, not shown, to perform a purging operation for sucking and removing air bubbles and foreign matters with ink from the nozzles 39 of the recording head 38. The flushing tank 44 is for receiving ink flushed from the nozzles 39 of the recording bead 38 by a flushing operation. Each of the purging mechanism 43 and the flushing tank 44 is one example of a maintenance unit for maintenance of the recording head 38 mounted on the carriage 40.

The base member 100 is divided into the following three regions in the front and rear direction 8: a first region 104 (as one example of a first base portion) located at a rear portion of the base member 100: a second region 105 (as one example of a second base portion) located at a central portion of the base member 100; and a third region 106 (as one example of a third base portion) located at a front portion of the base member 100. The first region 104 is located on the most upstream side 34 in the conveying direction 15 in the straight conveyance path. The second region 105 is located at a position located downstream of the first region 104 in the conveying direction 15 in the straight conveyance path 34 and upstream of the third region 106 in the conveying direction 15. The third region 106 is located on the most downstream side in the conveying direction 15 in the straight conveyance path 34.

Figure 5A:
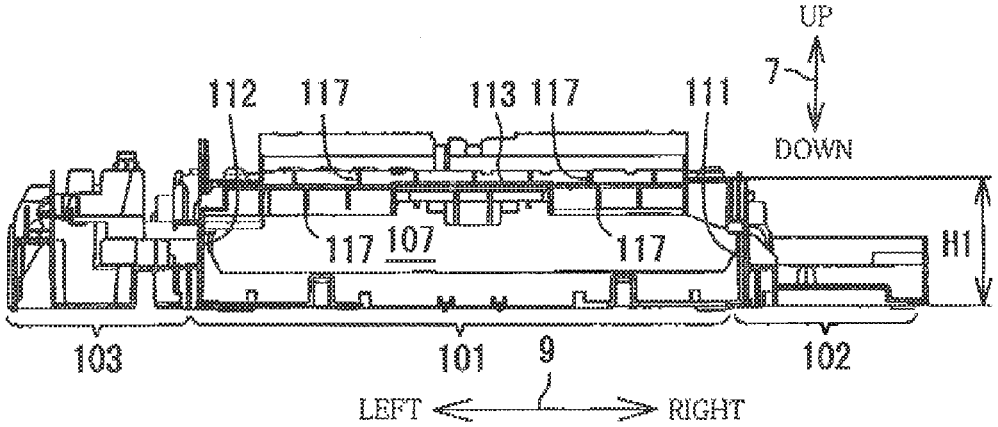
Figure 5B:
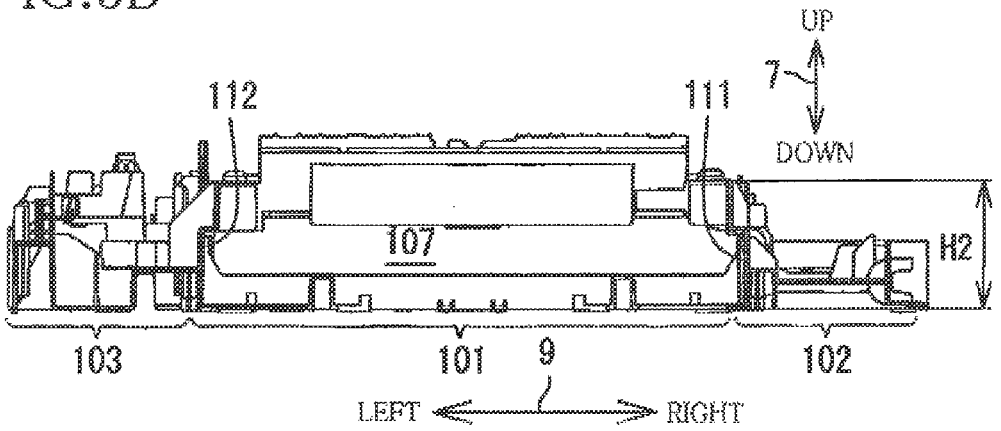
Figure 5C:
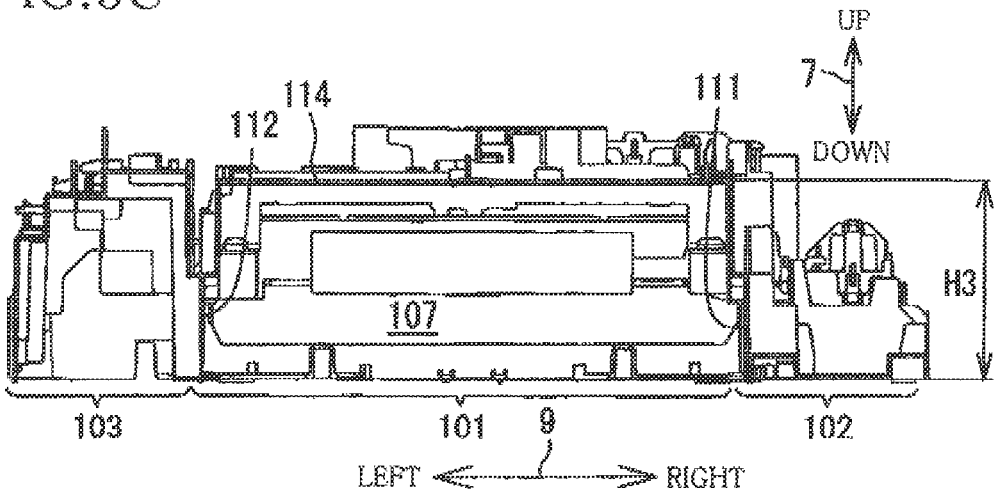

As illustrated in FIG. 5A, a portion of the center base 101 which is provided in the first region 104 is constituted by: a pair of side walls 111, 112 spaced apart from each other in the right and left direction 9; and a main board or wall 113 connecting between the pair of side walls 111, 112. As illustrated in FIG. 5C, a portion of the center base 101 which is provided in the third region 106 is constituted by the pair of side walls 111, 112 and a main board or wall 114 connecting between the pair of side walls 111, 112.

The side wall 111 projects or extends upward from an inner side of the side base 102, specifically, on the right edge of the center base 101 in the right and left direction 9. The side wall 112 projects or extends upward from an inner side of the side base 103, specifically, on the left edge of the center base 101 in the right and left direction 9. Also, as illustrated in FIGS. 5A, 5B, 5C, each of the side walls 111, 112 extends in the front and rear direction 8 on the first region 104, the second region 105, and the third region 106 of the base member 100. As illustrated in FIGS. 4A and 4B, a through hole 111A is formed in a portion of the side wall 111 which is located in the first region 104.

As illustrated in FIG. 5A, the main board 113 disposed in the first region 104 expands in the front and rear direction 8 and the right and left direction 9 between the pair of side walls 111, 112. As illustrated in FIG. 5C, the main board 114 disposed in the third region 106 expands in the front and rear direction 8 and the right and left direction 9 between the pair of side walls 111, 112. In the present embodiment, each of the main boards 113, 114 connects between upper edges (i.e., protruding edges) of the pair of side walls 111, 112. However, positions at which the main boards 113, 114 and the pair of side walls 111, 112 are connected are not limited to those in the above-described example. For example, the main boards 113, 114 may be connected to portions of the pair of side walls 111, 112 which are slightly lower than their respective upper edge. In view of the above, the main boards 113, 114 expand to connect the pair of side walls 111, 112 to each other at support portions thereof located above the first base portion and the second base portion.

As illustrated in FIG. 5B, in contrast, no main board for connecting between the pair of side walls 111, 112 is provided on a portion of the center base 101 which is located in the second region 105. In other words, the main boards 113, 114 are provided only in the first region 104 and the third region 106 of the center base 101. In other words, the main boards 113, 114 are spaced apart from each other in the front and rear direction 8, with the second region 105 therebetween.

A plurality of ribs 117, 118 are provided on an upper surface and a lower surface of the main board 113 disposed in the first region 104. The ribs 117 are provided on the upper surface and the lower surface of the main board 113 at positions spaced apart from each other in the right and left direction 9. Each of the ribs 117 extends in the up and down direction 7 and the front and rear direction 8. The ribs 118 are provided on the upper surface and the lower surface of the main board 113 at positions spaced apart from each other in the front and rear direction 8. Each of the ribs 118 extends in the up and down direction 7 and the right and left direction 9. Each of the ribs 117 provided on the lower surface of the main board 113 has through holes 117A, 117B. These through holes 117A, 117E and the through hole 111A formed in the side wall 111 lie on the same straight line extending in the right and left direction 9.

Figure 6:
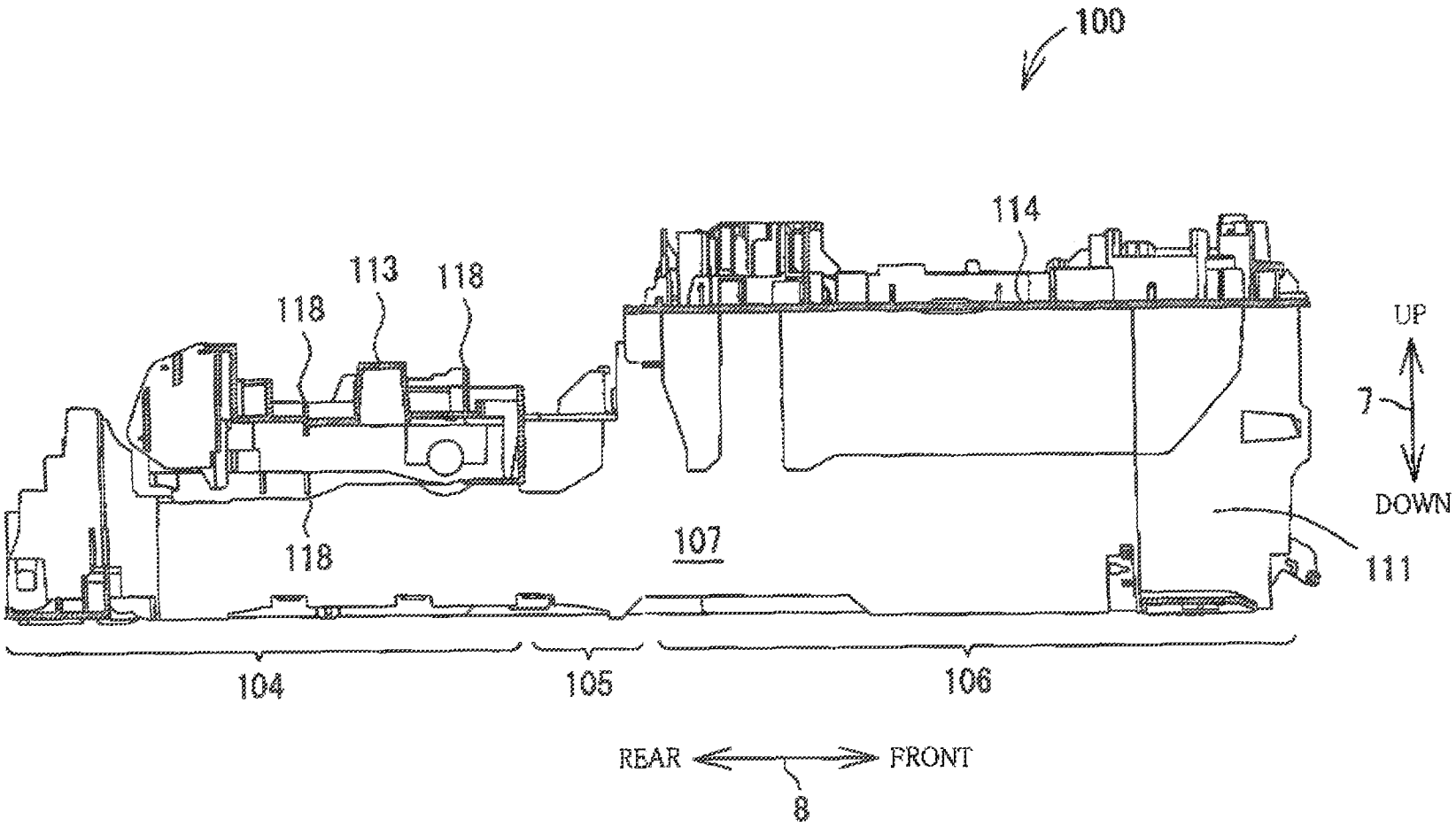
FIG. 6 is a cross-sectional view taken along line D-D in FIG. 4A.

As illustrated in FIGS. 5A-5C, the height of the side wall 111 in the first region 104 (i.e., the length thereof. In the up and down direction 7) is H1, the height of the side wall 111 in the second region 105 is H2, and the height of the side wall 111 in the third region 106 is H3. In the present embodiment, a relationship of these heights is as follows: H1=H2<H3. Accordingly, as illustrated in FIG. 6, the main board 114 disposed in the third region 106 is located at a higher position than the main board 113 disposed in the first region 104 in the up and down direction 7. However, the heights of the side wall 111 in the regions 104, 105, 106 are not limited to have the above-described relationship. It should be noted that the height H2 of the side wall 111 in the second region 105 is preferably lower than each of the heights H1, H3 of the side wall 111 in the first region 104 and the third region 106. In other words, the height of the side wall 111 in the second region 105 preferably is the lowest. These relationships apply to the height of the side wall 112.

Figure 7:
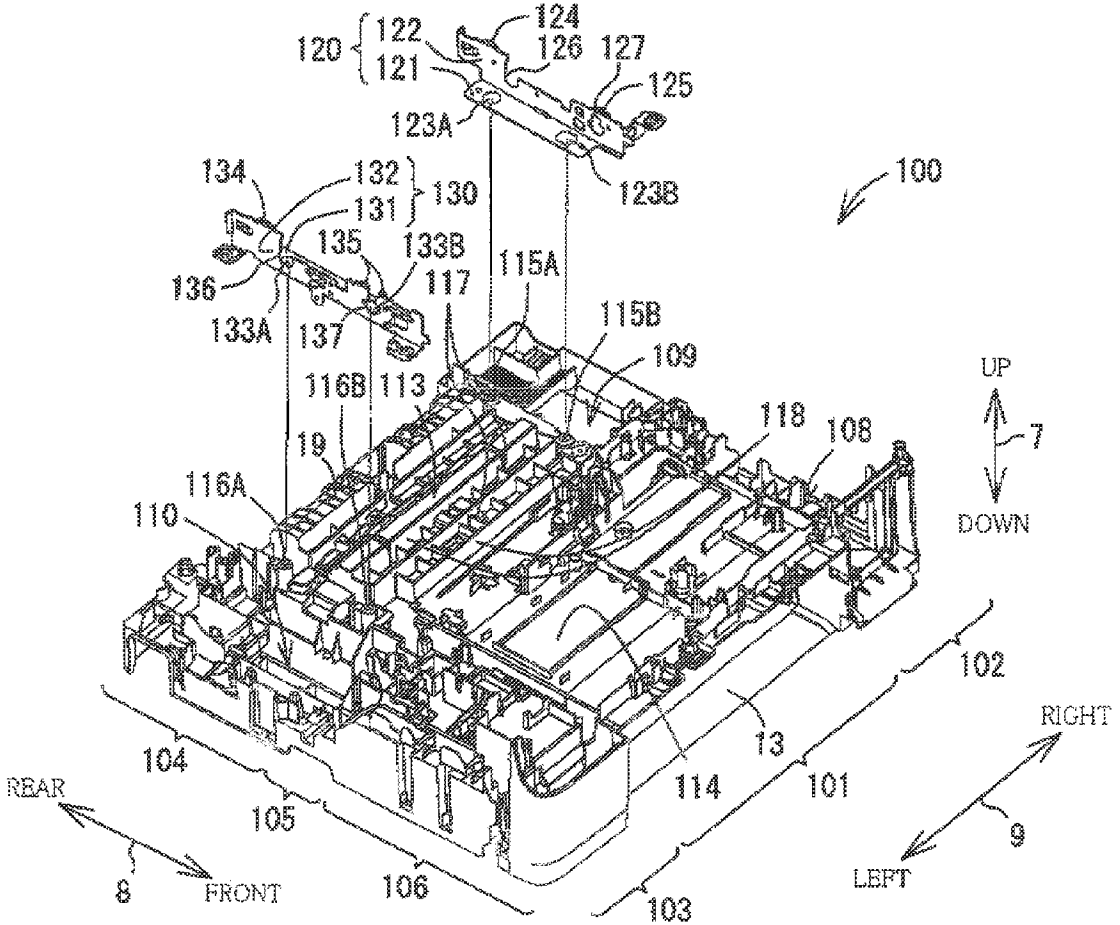
FIG. 7 is an exploded perspective view illustrating the base member 100 and side frames 120, 130.

As illustrated in FIG. 7, projections 115A, 115B, 116A, 116B are provided on opposite edge portions of the upper surface of the main board 113 in the right and left direction 9. The projections 115A, 115B are provided on a right edge portion of the upper surface of the main board 113 so as to be spaced apart from each other in the front and rear direction 8. The projections 116A, 116B are provided on a left edge portion of the upper surface of the main board 113 so as to be spaced apart from each other in the front and rear direction 8. Also, a generally central portion of each of the projections 115A, 115B, 116A, 116B has a threaded hole with which a screw as one example of a fastener is to be engaged.

As illustrated in FIG. 4B, the tray accommodation space 107 is defined by the pair of side walls 111, 112 and the main boards 113, 114. That is, the tray accommodation space 107 is formed under the main boards 113, 114 of the base member 100 in the up and down direction 7. The tray accommodation space 107 expands in the front and rear direction 8 over the first region 104, the second region 105, and the third region 106, that is, the tray accommodation space 107 expands over a generally entire area of the base member 100. Also, the tray accommodation space 107 is provided at a position corresponding to the center base 101 in the right and left direction 9, that is, the tray accommodation space 107 is provided on a central portion of the base member 100.

As illustrated in FIG. 4A, the inner guide member 19 is provided on a rear edge portion of the main board 113 in the front and rear direction 8, that is, the inner guide member 19 is provided on an upstream edge portion of the main board 113 in the conveying direction 15. The recording sheet 12 supported on the supply tray 20 guided by the inner guide member 19 from a side of the main board 113 nearer to its lower surface (as one example of a first surface) to a side of the main board 113 nearer to its upper surface (as one example of a second surface). The recording sheet 12 is then guided along the upper surface of the main board 113 and the lower face of the main board 114 to a front side in the front and rear direction 8. That is, the curved conveyance path 33 curves along the rear edge portion of the main board 113 from the lower face to the upper surface of the main board 113. The straight conveyance path 34 is linearly provided in the front and rear direction 8 in a horizontal plane expanding along the upper surface of the main board 113 and the lower face of the main board 114.

The support shaft 28 of the supply unit 16 is inserted in the through holes 111A, 117A, 117B. That is, the support shaft 28 is rotatably supported by the side wall 111 and the lower surface of the main board 113. The supply unit 16 is disposed in the tray accommodation space 107 and supplies the recording sheet 12 supported on the supply tray 20 to the conveyance path 35.

As illustrated in FIG. 7, a pair of side frames 120, 130 (as one example of a pair of metal walls) am mounted on the upper surface of the main board 113 disposed in the first region 104. The pair of side frames 120, 130 are spaced apart from each other in the right and left direction 9. Each of the side frames 120, 130 is formed by a sheet metal processing. The side frame 120 is constituted by a base portion 121 and a support wall 122 each shaped like a plate, such that the side frame 120 has a generally L-shape in cross section in a widthwise direction thereof. The side frame 130 is constituted by a base portion 131 and a support wall 132 each shaped like a plate, such that the side frame 130 has a generally L-shape in cross section in a widthwise direction thereof.

The base portion 121 is mounted on the upper surface of the main board 113, with its longitudinal direction coinciding with the front and rear direction 8. The base portion 121 has through holes 123A, 123B which are spaced apart from each other in the front and rear direction 8. The side frame 120 is mounted on the main board 113, so that the projections 115A, 115B are respectively inserted into the through holes 123A, 123B. That is, the projections 115A, 115B and the through holes 123A, 123B are provided at positions corresponding to each other to position the side frame 120 with respect to the main board 113 in the front and rear direction 8 and the right and left direction 9. Screws are respectively engaged with the threaded holes of the projections 115A, 115B, with the side frame 120 being mounted on the main board 113, whereby the side frame 120 is secured to the main board 113.

The support wall 122 stands on one of opposite edge portions of the base portion 121 in its widthwise direction. That is, the support wall 122 in the state in which the side frame 120 is mounted on the main board 113 expands upward and in the front and rear direction 8. The support wall 122 is provided with (i) projecting pieces 124, 125 each extending upward from an upper edge of the support wall 122 and (ii) a first receiver 126 and a second receiver 127 formed through the support wall 122 in its thickness direction. The projecting pieces 124, 125 and the first and second receivers 126, 127 are spaced apart from each other in a longitudinal direction of the side frame 120. The support wall 122 in the state in which the side frame 120 is mounted on the main board 113 is provided with the projecting piece 124, the first receiver 126, the second receiver 127, and the projecting piece 125 arranged in this order from the rear side to the front side in the front and rear direction 8.

The side frame 130 has a construction similar to that of the side frame 120. That is, the base portion 131 has through holes 133A, 133B. Also, the support wall 132 is provided with projecting pieces 134, 135, a first receiver 136, and a second receiver 137. In a state in which the side frames 120, 130 are mounted on the main board 113, the support walls 122, 132 face each other in the right and left direction 9. More specifically, the projecting pieces 124, 134 are opposed to each other in the front and rear direction 8, the projecting pieces 125, 135 to each other in the front and rear direction 8, the first receivers 126, 136 to each other in the front and rear direction 8, and the second receivers 127, 137 to each other in the front and rear direction 8.

Figure 8:
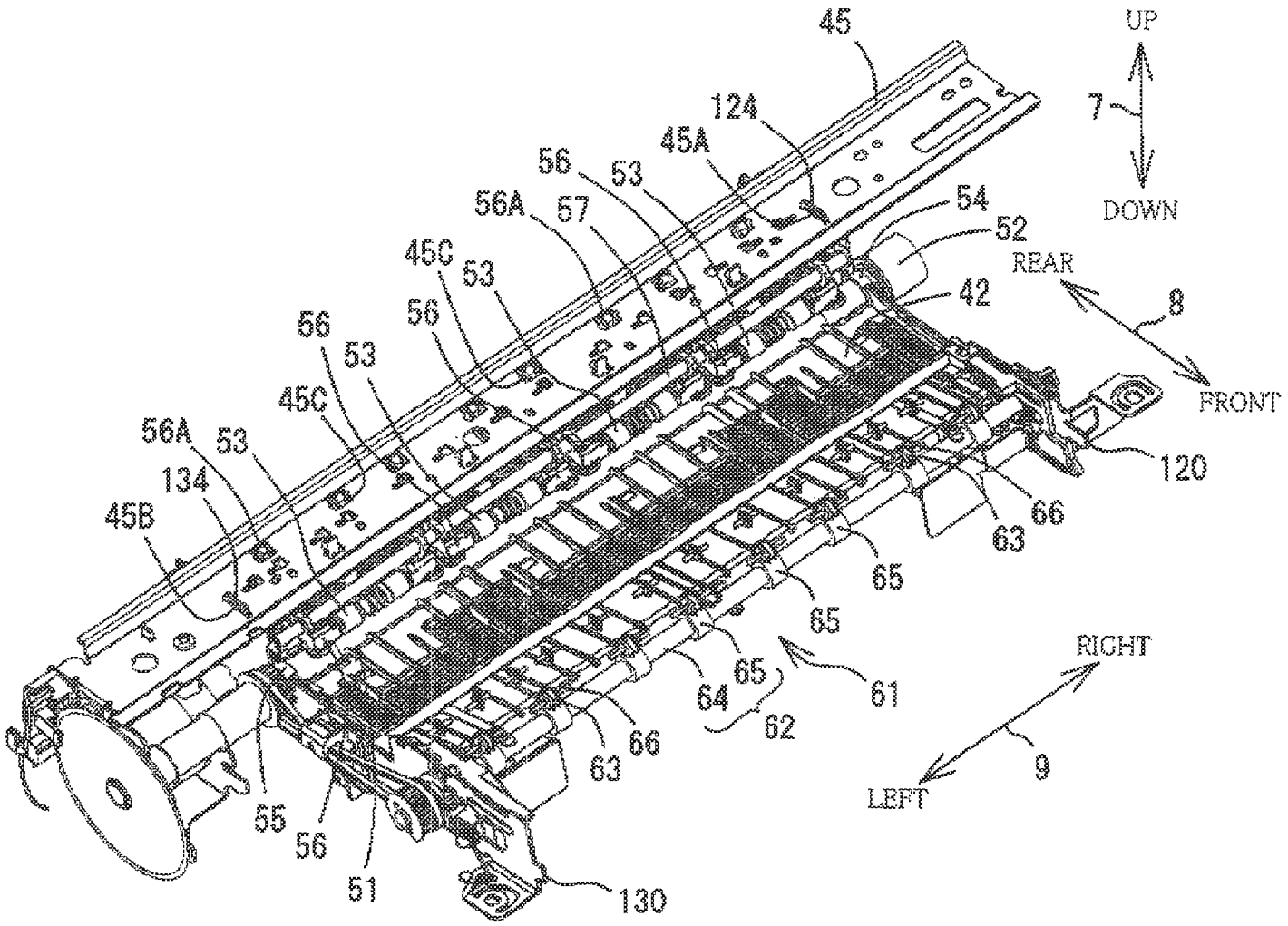
FIG. 8 is a perspective view illustrating a guide rail 45, a conveyor roller pair 51, a platen 42, and an output roller pair 61 supported by the side frames 120, 130.

As illustrated in FIG. 8, the guide rail 45 is supported by the side frames 120, 130. Specifically, the guide rail 45 has through holes 45A, 45B formed therethrough in its thickness direction (i.e., in the up and down direction 7 in FIG. 8) at positions spaced apart from each other in the right and left direction 9. These through holes 45A, 45B are formed at positions respectively corresponding to the projecting pieces 124, 134 of the side frames 120, 130 and have shapes respectively corresponding to the projecting pieces 124, 134. That is, the guide rail 45 is supported by upper sides of the side frames 120, 130, so that the projecting pieces 124, 134 are inserted into the through holes 45A, 45B, respectively. As a result, the guide rail 45 is positioned with respect to the side frames 120, 130 (in other words, the base member 100) in the front and rear direction 8 and the right and left direction 9.

Though not illustrated, the guide rail 46 is, like the guide rail 45, supported by the upper sides of the side frames 120, 130 and positioned by the projecting pieces 125, 135 in the front and rear direction 8 and the right and left direction 9. That is, the guide rails 45, 46 are supported by the side frames 120, 130 at positions spaced apart from each other in the front and rear direction 8 and extend in the right and left direction 9.

As illustrated in FIG. 9, the guide rails 45, 46 extend through the center base 101 to the side bases 102, 103 in the right and left direction 9. That is, the carriage 40 is movable through an area opposed to the center base 101 to positions opposed to the side bases 102, 103.

The purging mechanism 43 is provided on a portion of the side base 102 which is located in the first region 104. Specifically, the purging mechanism 43 is provided at a position opposed to the carriage 40 having moved to a position on the side base 102. The purging operation is performed for the carriage 40 having moved along the guide rails 45, 46 to a position opposed to the purging mechanism 43. Likewise, the flushing tank 44 is provided on a portion of the side base 102 which is located in the first region 104. Specifically, the flushing tank 44 is provided at a position opposed to the carriage 40 having moved to a position on the side base 103. The flushing operation is performed for the carriage 40 having moved along the guide rails 45, 46 to a position opposed to the flushing tank 44.

As illustrated in FIG. 8, fitted on the conveyor roller 52 are bearings 54, 55 which are spaced apart from each other in an axial direction of the conveyor roller 52 (i.e., in the right and left direction 9 in FIG. 8). Specifically, the bearings 54, 55 are fitted on the conveyor roller 52 at positions corresponding to the first receivers 126, 136 of the side frames 120, 130. The bearing 54 is supported by the first receiver 126 of the side frame 120, and the bearing 55 is supported by the first receiver 136 of the side frame 130.

The conveyor roller pair 51 includes the pinch rollers 53 (four rollers in the present embodiment) which are spaced apart from each other in the axial direction of the conveyor roller 52. The pinch rollers 53 are respectively supported rotatably by a plurality of roller holders 56 (four roller holders in the present embodiment). Each of the roller holders 56 includes an engaging portion 56A. The engaging portion 56A is engaged with an upper surface of the guide rail 45 in a state in which the engaging portion 56A passes through a through hole 45C that is formed through the guide rail 45 in its thickness direction. That is, the roller holders 56 are supported by the guide rail 45.

The roller holders 56 are connected to a release shaft 57. The release shaft 57 extends parallel to a shaft of the conveyor roller 52 and is movable in a radial direction together with the roller holders 56. Urging members, not shown are arranged between the guide rail 45 and the respective roller holders 56 to urge the respective roller holders 56 (in other words, the respective pinch rollers 53) onto the conveyor roller 52.

The output roller 62 is constituted by the shaft 64 and the rollers 65 fitted on the shaft 64 at positions spaced apart from each other in the axial direction. The shaft 64 is rotatably supported by the side frames 120, 130 via bearings, not shown, that are fitted on the shaft 64 at positions spaced apart from each other in its axial direction. More specifically, the bearings fitted on the shaft 64 are supported by the second receivers 127, 137 of the side frames 120, 130. The spurs 63 are provided at positions respectively corresponding to the rollers 65 of the output roller 62. The spurs 63 are rotatably supported by the respective shafts 66. Each of the spurs 63 is supported by a support plate, not shown. This support plate is supported by the guide rail 46.

As described above, the guide rails 45, 46, the supply unit 16, the conveyor roller pair 51, and the output roller pair 61 are supported by the side frames 120, 130. The carriage 40 (in other words, the recording unit 24) is supported by the side frames 120, 130 via the guide rails 45, 46. That is, the guide rails 45, 46, the supply unit 16, the conveyor roller pair 51, the recording unit 24, and the output roller pair 61 are supported by the base member 100 in the first region 104.

Figure 10:
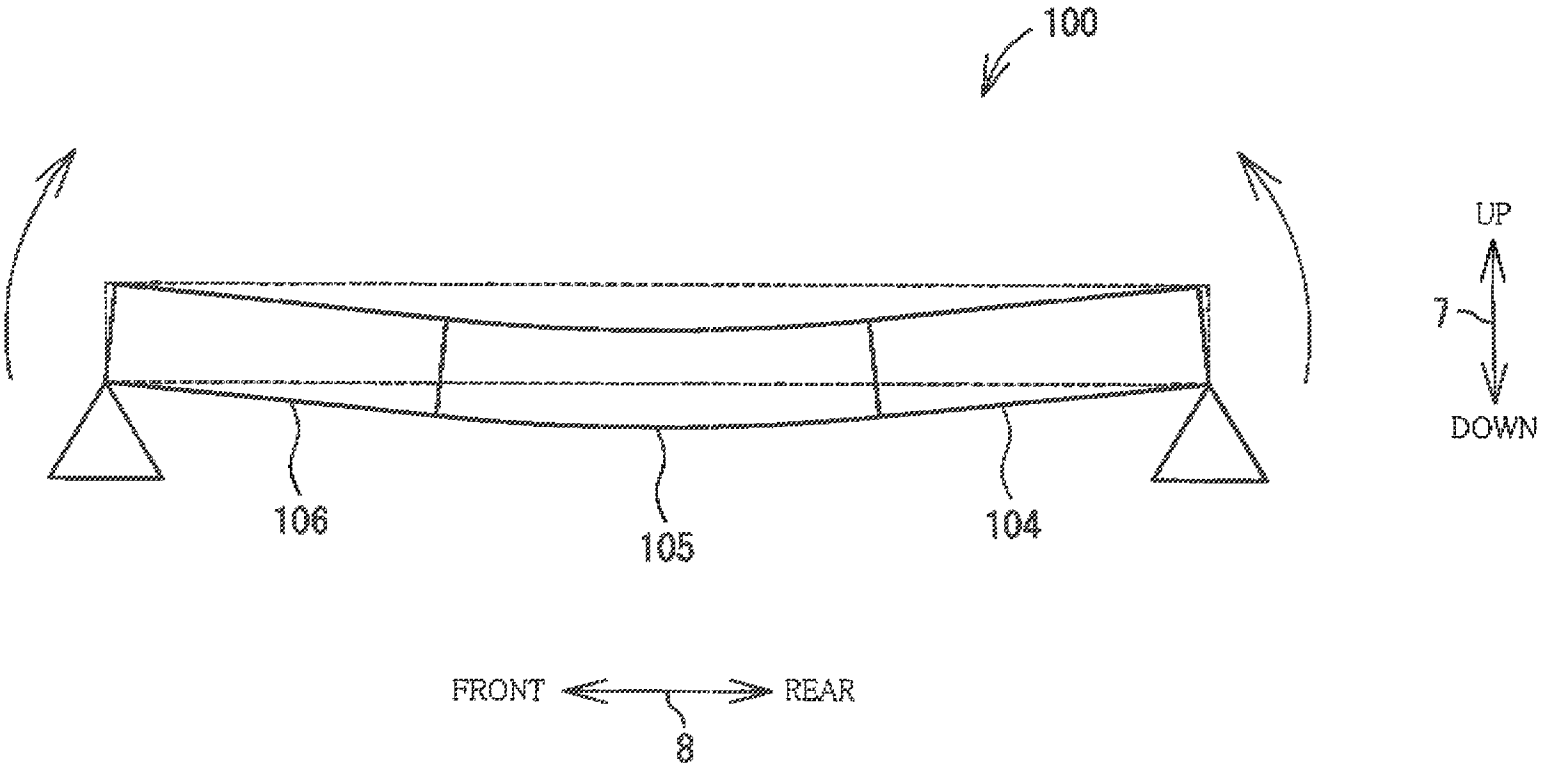
FIG. 10 is a schematic view illustrating shapes of the base member 100 before and after deformation of the base member 100 to which a bending moment is applied.

FIG. 10 is a schematic view illustrating the base member 100 in a plane expanding in the up and down direction 7 and the front and rear direction 8 (in other words, FIG. 10 is a plan view illustrating the base member 100 when viewed in the right and left direction 9). The broken lines in FIG. 10 indicate a shape of the base member 100 before deformation, and solid lines indicate a shape of the base member 100 after deformation.

As illustrated in FIG. 10, in a case where the base member 100 is supported at only its front and rear edges, the base member 100 receives a bending moment in a direction in which the base member 100 is deformed in a downward convex shape (i.e., in a direction indicated by arrows in FIG. 10). It is noted that this situation may be caused in a case where the MFP 10 is placed over a step or in a case where the MFP 10 is raised with front and rear edges thereof being grasped, for example. In order to reduce an amount of lowering in quality of image recording due to the bending moment in such a situation, the base member 100 in the present embodiment is configured such that the flexural rigidity of the base member 100 in the second region 105 with respect to the bending moment is set to be smaller than that of the base member 100 in each of the first region 104 and the third region 106.

It is noted that the flexural rigidity of the base member 100 in the second region 105 can be reduced by, for example, providing no main board for connecting between the pair of side walls 111, 112 or lowering the height of the side walls 111, 112 in the second region 105. On the other hand, the flexural rigidity of the base member 100 in the first region 104 and the third region 106 can be made higher by, for example, providing the main boards 113, 114 for connecting between the pair of side walls 111, 112, making higher the height of the side walls 111, 112 in the first region 104 and the third region 106, or providing the ribs 117 on the surface(s) of the main board 113.

Effects of the Present Embodiment

The flexural rigidities of the base member 100 in the first region 104, the second region 105, and the third region 106 are set as described above. Thus, in a case where an external force (i.e., the bending moment) illustrated in FIG. 10 is applied to the MFP 10, the second region 105 of the base member 100 is greatly deformed. Though the first region 104 and the third region 106 are inclined with deformation of the base member 100 in the second region 105, an amount of their deformation is considerably small when compared with an amount of the deformation of the base member 100 in the second region 105.

That is, the external force applied to the base member 100 is absorbed by the second region 105, resulting in reduction in the external force transmitted to the first region 104 and the third region 106. This prevents positional displacement of components supported by the main board 113 disposed in the first region 104, such as the recording unit 24, the supply unit 16, the conveyor roller pair 51, and the output roller pair 61. Thus, it is possible to reduce an amount of lowering in quality of image recording performed by the printing section 11. Furthermore, it is possible to prevent deformation of the control board 47 supported by the main board 114 disposed in the third region 106.

Also, the components such as the recording unit 24, the guide rails 45, 46, the conveyor roller pair 51, and the output roller pair 61 are supported by the side frames 120, 130 mounted on the main board 113 that is less deformed, allowing these components to be positioned accurately. Thus, it is possible to further reduce the amount of lowering in quality of image recording performed by the printing section 11.

It is noted that a concrete means for making the flexural rigidity of the base member 100 in the second region 105 smaller than that of the base member 100 in the first region 104 and the third region 106 is not limited to the means described above. For example, the thickness of a resin plate constituting the second region 105 (e.g., the side walls 111, 112) may be thinner than that of the plate constituting each of the first region 104 and the third region 106. Alternatively, an amount of resin per unit volume of the base member 100 in the second region 105 (i.e., the density of resin) may be made smaller than that of the base member 100 in the first region 104 and the third region 106.

While the base member 100 is a hollow member having the tray accommodation space 107 inside it in the present embodiment, the present invention is not limited to this structure. For example, the base member 100 may have a structure not having a large space like the tray accommodation space 107, that is, the base member 100 may have a high density of resin. In this structure, to make the flexural rigidity of the base member 100 in the second region smaller than that of the base member 100 in the first region and the third region, the height of the base member 100 in the second region only needs to be made smaller in the up and down direction 7 than the height of the base member 100 in the first region and the third region, for example. However, the present invention exhibits prominent effects by being applied to the base member 100 having a large space like the tray accommodation space 107 inside it, i.e., the base member 100 having a low density of resin, as illustrated in FIGS. 4A and 4B.

In the present embodiment, a relationship of the flexural rigidity with respect to the bending moment illustrated in FIG. 10 is explained above, but the present invention is not limited to the relationship explained above. The stiffness of the base member 100 in the second region 105 is preferably smaller than that of the base member 100 in the first region 104 and the third region 106 with respect to external forces acting on the base member 100 other than a bending load. For example, the stiffness of the base member 100 in the second region 105 may be smaller than that of the base member 100 in the first region 104 and the third region 106 with respect to a compression load (or a tension load) applied to the MFP 10 in the front and rear direction 8.

In the present embodiment, the supply tray 20 and the supply unit 16 are disposed on a side of the main board 113 nearer to the lower surface, and the conveyor roller pair 51, the recording unit 24, the output roller pair 61, and so on are disposed on a side of the main board 113 nearer to the upper surface, and the curved conveyance path 33 is formed between the components disposed on the lower-surface side and the components disposed on the upper-surface side. Thus, the MFP 10 can be made smaller in sire. However the present invention is not limited to this construction and may be applied to an ink-jet recording apparatus having only the straight conveyance path 34.

In the example explained above, the front and rear direction 8 is the first direction, the up and down direction 7 is the second direction, and the right and left direction 9 is the third direction in the present embodiment, but the present invention is not limited to this relationship. For example, the right and left direction 9 and the front and rear direction 8 may be the first direction and the third direction, respectively, and other combinations may be possible.

What is claimed is:

1. An ink-jet recording apparatus comprising:

a base member made of resin material;

a conveyor unit supported by the base member and configured to convey a sheet in a conveying direction that is parallel to a first direction; and a recording unit supported by the base member and configured to eject ink to record an image on the sheet in a state in which the recording unit is opposed to the sheet in a second direction perpendicular to the first direction;

wherein the base member is divided into:

(i) a first base portion that supports the conveyor unit and the recording unit, (ii) a second base portion contiguous to the first base portion and located downstream of the first base portion in the conveying direction; and (iii) a third base portion contiguous to the second base portion and located downstream of the second base portion in the conveying direction;

wherein a stiffness of the second base portion is less than that of each of the first base portion and the third base portion; and wherein the base member comprises:

a pair of side walls each extending the first direction on the first base portion, the second base portion, and the third base portion and extending in the second direction in a state in which the pair of side walls are spaced apart from each other in a third direction that is perpendicular to each of the first direction and the second direction; and a connecting member connecting the pair of side walls to each other only in the first base portion and the third base portion.

2. The ink-jet recording apparatus according to claim 1;

wherein a length of the second base portion in the second direction is less than that of each of the first base portion and the third base portion in the second direction.

3. The ink-jet recording apparatus according to claim 1;

wherein the connecting member is a main board expanding to connect the pair of side walls to each other only in the first base portion and the third base portion.

4. The ink-jet recording apparatus according to claim 3;

wherein a length of each of the pair of side walls in the second direction in the second base portion is less than that of each of the pair of side walls in the second direction in the third base portion.

5. The ink-jet recording apparatus according to claim 3;

wherein a length of each of the pair of side walls in the second direction in the second base portion is less than that of the pair of side walls in the second direction in each of the first base portion and the third base portion.

6. The ink-jet recording apparatus according to claim 3, further comprising:

a pair of metal walls supported by a portion of the main board which is located in the first base portion, the pair of metal walls being spaced apart from each other in the third direction; and a guide rail supported by the pair of metal walls and extending in the third direction, wherein the recording unit comprises:

a carriage supported by the guide rail and reciprocated in the third direction; and a recording head mounted on the carriage and configured to eject ink from a plurality of nozzles; and wherein the conveyor unit comprises:

a conveyor roller supported by the pair of metal walls at a position located upstream of the recording head in the conveying direction; and an output roller supported by the pair of metal walls at a position located downstream of the recording head in the conveying direction.

7. The ink-jet recording apparatus according to claim 6, further comprising:

a tray disposed in a space defined by the pair of side walls and the main board, the tray being configured to support the sheet; and a supply unit supported by the main board and one of the pair of side walls and configured to supply the sheet supported by the tray to the conveyor roller.

8. The ink-jet recording apparatus according to claim 7;

wherein the main board comprises a first surface and a second surface opposed to each other in the second direction;

wherein a distance between die first surface and the space in which the tray is disposed is less than a distance between the second surface and the space;

wherein the first surface supports the supply unit, and the second surface supports the pair of metal walls; and wherein an upstream edge portion of the main board in the conveying direction serves as a guide that guides the sheet supplied by the supply unit, from a side of the main board near the first surface to a side of the main board near the second surface.

9. The ink-jet recording apparatus according to claim 6;

wherein the pair of metal walls are screwed to the main board.

10. The ink-jet recording apparatus according to claim 3;

wherein at least one rib projecting in the second direction and extending in the first direction is formed on a portion of the main board which is located in the first base portion.

11. The ink-jet recording apparatus according to claim 3, further comprising:

a control board supported by a portion of the main board which is located above the third base portion, the control board being configured to control the conveyor unit and the recording unit.

* * * * *